US006255271B1

(12) United States Patent
Carswell et al.

(10) Patent No.: US 6,255,271 B1
(45) Date of Patent: Jul. 3, 2001

(54) FABRIC CARE COMPOSITION

(75) Inventors: Robert John Carswell; Anthony Nicholas Jarvis; Adelle Louise Killey; William Mooney; Andrew Philip Parker; Emily Jane Peckham; Zhengwu Shen, all of Bebington (GB)

(73) Assignee: Unilever Home & Personal Care, USA, division of Conopco, Greenwich, CT (US)

( * ) Notice: Subject to any disclaimer, the term of this patent is extended or adjusted under 35 U.S.C. 154(b) by 0 days.

(21) Appl. No.: 09/397,706

(22) Filed: Sep. 16, 1999

(30) Foreign Application Priority Data

Sep. 16, 1998 (GB) ..... 9820206
May 17, 1999 (GB) ..... 9911474

(51) Int. Cl.[7] ..... C11D 7/26; C11D 7/32; C11D 7/50

(52) U.S. Cl. ..... 510/328; 510/292; 510/327; 510/332; 510/336; 510/337; 510/338; 510/394; 510/396; 510/397; 510/499; 510/501; 510/466; 510/521; 510/522; 510/527

(58) Field of Search ..... 510/292, 327, 510/332, 336, 337, 338, 394, 396, 397, 499, 501, 466, 521, 522, 527, 328; 8/137

(56) References Cited

U.S. PATENT DOCUMENTS

| | | | |
|---|---|---|---|
| 3,949,014 | 4/1976 | Maki et al. | 525/187 |
| 4,371,517 | 2/1983 | Vanlerberghe et al. | 424/70.1 |
| 4,531,946 | 7/1985 | Christie et al. | 8/192 |
| 4,605,418 | 8/1986 | Christie et al. | 8/192 |
| 4,735,738 | 4/1988 | Willman | 510/330 |
| 5,393,304 | 2/1995 | Vuilaume et al. | 8/194 |
| 5,908,707 * | 6/1999 | Cabell et al. | 428/537.5 |

FOREIGN PATENT DOCUMENTS

| | | |
|---|---|---|
| 221922 | 5/1985 | (DE) . |
| 0315477 | 5/1989 | (EP) . |
| 0341205 | 11/1989 | (EP) . |
| 0372782 | 6/1990 | (EP) . |
| 0459822 | 12/1991 | (EP) . |
| 1379203 | 1/1975 | (GB) . |
| 2063892 | 6/1981 | (GB) . |
| 2089855 | 6/1982 | (GB) . |
| 2268516 | 1/1994 | (GB) . |
| 96/15309 | 5/1996 | (WO) . |
| 96/15310 | 5/1996 | (WO) . |
| 96/21715 | 7/1996 | (WO) . |
| 96/26831 | 9/1996 | (WO) . |
| 97/42287 | 11/1997 | (WO) . |
| 97/42289 | 11/1997 | (WO) . |
| 98/29530 | 7/1998 | (WO) . |
| 99/06519 | 2/1999 | (WO) . |
| 99/09127 | 2/1999 | (WO) . |
| 99/15611 | 4/1999 | (WO) . |
| 99/15612 | 4/1999 | (WO) . |

OTHER PUBLICATIONS

Wet Strength Resins and Their Application, ed L L Chan, Tappi Press, Atlanta, 1994 No Month Available.

European Search Report dated Dec. 6, 1999 (PCT/EP 99/06429).

European Search Report dated Dec. 6, 1999 (PCT/EP 99/06430).

European Search Report dated Dec. 6, 1999 (PCT/EP 99/06431).

* cited by examiner

*Primary Examiner*—Gregory Delcotto

(57) ABSTRACT

A fabric care composition comprises an amine or amide-epichlorohydrin resin or derivative thereof, a silicone component and, optionally, a textile compatible carrier. The textile compatible carrier facilitates contact between the resin and a fabric. The composition is adapted for use in the rinse cycle of a laundering process and may be used, as part of such a process, in the treatment of fabric to reduce creasing of the fabric.

10 Claims, No Drawings

FABRIC CARE COMPOSITION

TECHNICAL FIELD

The present invention relates to fabric care compositions. In particular the invention relates to compositions applied to fabric, during the laundry process and which have a number of added benefits over and above the usual benefits from the laundry process. A method of treatment of fabric with the composition of the invention is provided and so is the use of the compositions to provide various benefits from treatment of the fabric.

BACKGROUND AND PRIOR ART

The laundry process generally has several benefits for fabric, the most common being to remove dirt and stains from the fabric during the wash cycle and to soften the fabric during the rinse cycle. However, there are numerous disadvantages associated with repeated use of conventional laundry treatment compositions and/or the actual laundry process; one of these being a fairly harsh treatment of fabric in the laundry process.

Fabrics can be damaged in several ways as a result of repeated laundering and/or wear. Fabric pilling and loss of fabric surface appearance e.g. fuzzing, shrinkage (or expansion), loss of colour from the fabric or running of colour on the fabric (usually termed dye transfer) are some of the common problems associated with repeated laundering. These problems may occur merely from repeated hand washing as well as the more vigorous machine washing process. Furthermore, Problems relating to damage of fabric over time through normal use, such as loss of shape and increased likelihood of wrinkling are also significant.

Laundry detergent compositions containing polyamines, optionally alkoxylated are described in WO 97/42287. The detergent compositions may contain, as suds suppressors, polyorganosiloxane oils. However, there is no mention of the polyorganosiloxane oils having any function other than acting as suds suppressors. Laundry compositions containing polyamide-polyamine fabric treatment agents are described in WO 98/29530 and the detergent compositions are said to impart improved overall appearance to fabrics laundered using the compositions.

WO 96/15309 and WO 96/15310 describe sprayable anti-wrinkle compositions which contain a silicone and a film-forming polymer. The compositions are dispensed from a sprayer and are used as a spray treatment or as an ironing aid. However, an inherent problem with spray dispensed treatments is that they can result in localisation of the compositions in concentrated regions (so-called "spotting").

A process for treating fabric on an industrial scale is disclosed in EP-A-0372782. The process involves the use of an amino functional polymer and a silicone capable of reacting with reactive groupings on the amino functional polymer, the silicone generally being present in greater amounts than the amino functional polymer. The process is carried out either continuously or as a batch process and is said to impart a softer handle to the fabric.

U.S. Pat. No. 3949014 relates to a binder for fibres which contains a polyamine-epichlorohydrin resin and an amphoteric high molecular weight compound having at least 2 cationic groups and at least 2 anionic groups per molecule. The treatment described in this document is intended to be carried out industrially as part of a fabric treatment process rather than as part of a domestic laundering process and this is supported by the fact that the fabric treated with the binder required curing at a relatively high temperature. Industrial curing of fabrics treated with this type of polymer system is normally carried out at about 150° C.

U.S. Pat. No. 4371517 discloses compositions for treating fibrous materials which contain cationic and anionic polymers. The document does not deal with domestic treatments and does not relate to fabric treatment compositions containing silicones.

Co-emulsifiers, based on cationic quaternary amine polymers, are taught in DD 221922 for use in fabric softener and other compositions.

The present invention is directed towards alleviating one or more of the problems referred to hereinabove.

The principal advantage of the present invention relates to reduced creasing of the fabric (compared to fabrics treated with conventional compositions) as a result of treatment with the compositions of the present invention. It will be understood that the creasing of the fabric which is reduced in the present invention is the generally undesirable creasing of the fabric which occurs in use or during the washing and/or drying of the fabric, and is usually removed by ironing or otherwise pressing the fabric, during a domestic laundering process.

The invention has the further advantage of increasing the dimensional stability of the fabric. The term "dimensional stability", and related terms, used herein covers not only shrinkage of fabrics but also shape retention and bagginess reduction in fabrics.

Definition of the Invention

The present invention relates to compositions for use in the treatment and care of fabric.

Thus according to one aspect of the invention there is provided a fabric care composition comprising an amine or amide-epichlorohydrin resin or derivative thereof, a silicone component and, optionally, a textile compatible carrier, wherein the textile compatible carrier facilitates contact between the resin and a fabric, the composition being adapted for use in the rinse cycle of a laundering process.

A second aspect of the invention relates to the use of the compositions of the invention to reduce creasing of the fabric.

The invention further provides a method of treating fabric in which a composition of the invention is applied to the fabric as part of a laundering process. The laundering processes of the invention include the large scale and small scale (eg domestic) cleaning of fabrics.

Detailed Description of the Invention

The compositions of the present invention comprise, as the first component, at least one amine or amide epichlorohydrin resin or derivatives thereof.

In the context of the present invention these first materials are polymeric, or at least oligomeric, in nature. Preferably, they have a weight average mean molecular weight of from 300 to 1,000,000 daltons.

The resins of the invention are sometimes referred to below as amine-epichlorohydrin resins and polyamine-epichlorohydrin (PAE) resins (the two terms being used synonymously) although these terms encompass both the amine and amide resins of the invention. The resins may also have a mixture of amine and amide groups.

The amine or amide-epichlorohydrin resins may have one or more functional groups capable of forming azetidinium groups and/or one or more azetidinium functional groups.

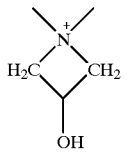

Alternatively, or additionally the resins may have one or more functional groups that contain epoxide groups or derivatives thereof e.g. Kymene 450™ (ex Hercules).

Suitable polyamine-epichlorohydrin (PAE) resins include those described in 'Wet Strength Resins and Their Application', pp 16–36, ed. L. L. Chan, Tappi Press, Atlanta, 1994. Suitable PAE resins can be identified by selecting those resins which impart increased wet strength to paper, after treatment, in a relatively simple test.

Any amine or amide-epichlorohydrin resin having an epoxide functional group or derivative thereof is suitable for use according to the invention.

A particularly preferred class of amine or amide-epichlorohydrin resins for use in the invention are secondary amine or amide-based azetidinium resins, for example, those resins derived from a polyalkylene polyamine e.g. diethylenetriamine (DETA), a polycarboxylic acid e.g. adipic acid or other dicarboxylic acids, and epichlorohydrin. Other polyamines or polyamides can also be advantageously used in the preparation of suitable PAE resins.

Another preferred class of amine-epichlorohydrin resins for use in the invention are those having an epoxide functional group of derivative thereof e.g. chlorohydrin.

The resin is preferably present in the product in a sufficient quantity to give an amount of 0.0005% to 5% by weight on the fabric based on the weight of the fabric, more preferably 0.001% to 2% by weight on fabric. The amount of the first component in the composition required to achieve the above % by weight on fabric will typically be in the range 0.01% to 35% by weight, preferably 0.1% to 13.5% by weight.

The resin may be PDAA-epichlorohydrin resins or PMDAA-epichlorohydrin resins. PDAA is poly (diallylamine) and PMDAA is poly(methyldiallyl(amine)).

The compositions of the invention, when applied to a fabric, can impart benefits to the fabric when uncured. However, they may be cured by a domestic curing step including ironing and/or domestic tumble drying, preferably tumble drying. The curing is preferably carried out at a temperature in the range of from 50 to 100° C., more preferably from 80 to 100° C.

The compositions of the invention comprise a silicone component. It is preferred if the silicone component is a dimethylpolysiloxane with amino alkyl groups. It may be used in the context of the present invention as an emulsion in water.

It is preferred if the silicone component is present in a ratio of first component: silicone of from 1:1 to 30:1, more preferably 1:1 to 20:1 (eg, 2:1 to 20:1) and most preferably 5:1 to 15:1.

In the context of the present invention the term 'textile compatible carrier' is a component which can assist in the interaction of the first component with the fabric. The carrier can also provide benefits in addition to those provided by the first component e.g. softening, cleaning etc. The carrier may be water or a detergent-active compound or a fabric softener or conditioning compound or other suitable detergent or fabric treatment agent.

The compositions of the invention are adapted to be used in the rinse cycle of a laundry process as part of a conventional fabric treatment product and may be packaged and labelled as such. Preferably the rinse cycle follows treatment of the fabric with a detergent. The laundry process is preferably a domestic laundering process.

The fabrics which may be treated in the present invention comprise cellulosic fibres, preferably from 1% to 100% cellulosic fibres (more preferably 5% to 100% cellulosic fibres, most preferably 40% to 100% such as 75% to 100%). When the fabric contains less than 100% cellulosic fibres, the balance comprises other fibres or blends of fibres suitable for use in garments such as polyester, for example. Preferably, the cellulosic fibres are of cotton or regenerated cellulose such as viscose.

The composition may be a rinse adjunct, in which case it may contain only water, the PAE resin and the silicone component. However, the composition preferably comprises also a perfume agent, and, optionally, other conventional additives in rinse adjuncts.

If the composition of the invention is a rinse conditioner, it will preferably comprise a textile-compatible carrier which is a fabric softening and/or conditioning compound.

Fabric Softening and/or Conditioner Compounds

If the composition of the present invention is in the form of a fabric conditioner composition, the textile-compatible carrier will be a fabric softening and/or conditioning compound (hereinafter referred to as "fabric softening compound"), which may be a cationic or nonionic compound.

The softening and/or conditioning compounds may be water insoluble quaternary ammonium compounds. The compounds may be present in amounts of up to 8% by weight (based on the total amount of the composition) in which case the compositions are considered dilute, or at levels from 8% to about 50% by weight, in which case the compositions are considered concentrates.

Compositions suitable for delivery during the rinse cycle may also be delivered to the fabric in the tumble dryer if used in a suitable form. Thus, another product form is a composition (for example, a paste) suitable for coating onto, and delivery from, a substrate e.g. a flexible sheet or sponge or a suitable dispenser during a tumble dryer cycle.

Suitable cationic fabric softening compounds are substantially water-insoluble quaternary ammonium materials comprising a single alkyl or alkenyl long chain having an average chain length greater than or equal to $C_{20}$ or, more preferably, compounds comprising a polar head group and two alkyl or alkenyl chains having an average chain length greater than or equal to $C_{14}$. Preferably the fabric softening compounds have two long chain alkyl or alkenyl chains each having an average chain length greater than or equal to $C_{16}$. Most preferably at least 50% of the long chain alkyl or alkenyl groups have a chain length of $C_{18}$ or above. It is preferred if the long chain alkyl or alkenyl groups of the fabric softening compound are predominantly linear.

Quaternary ammonium compounds having two long-chain aliphatic groups, for example, distearyldimethyl ammonium chloride and di(hardened tallow alkyl) dimethyl ammonium chloride, are widely used in commercially available rinse conditioner compositions. Other examples of these cationic compounds are to be found in "Surface-Active Agents and Detergents", Volumes I and II, by Schwartz, Perry and Berch. Any of the conventional types of such compounds may be used in the compositions of the present invention.

The fabric softening compounds are preferably compounds that provide excellent softening, and are characterised by a chain melting $L\beta$ to $L\alpha$ transition temperature greater than 25° C., preferably greater than 35° C., most preferably greater than 45° C. This Lβ to Lα transition can be measured by DSC as defined in "Handbook of Lipid Bilayers", D Marsh, CRC Press, Boca Raton, Fla., 1990 (pages 137 and 337).

Substantially water-insoluble fabric softening compounds are defined as fabric softening compounds having a solubility of less than $1\times10^{-3}$ wt % in demineralised water at 20° C. Preferably the fabric softening compounds have a solubility of less than $1\times10^{-4}$ wt %, more preferably less than $1\times10^{-8}$ to $1\times10^{-6}$ wt %.

Especially preferred are cationic fabric softening compounds that are water-insoluble quaternary ammonium materials having two $C_{12-22}$ alkyl or alkenyl groups connected to the molecule via at least one ester link, preferably two ester links. An especially preferred ester-linked quaternary ammonium material can be represented by the formula II:

(II)

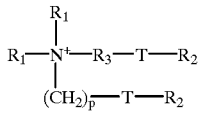

wherein each $R_1$ group is independently selected from $C_{1-4}$ alkyl or hydroxyalkyl groups or $C_{2-4}$ alkenyl groups; each $R_2$ group is independently selected from $C_{8-28}$ alkyl or alkenyl groups; and wherein —$R_3$— is a linear or branched alkylene group of 1 to 5 carbon atoms, T is

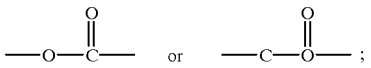

and p is 0 or is an integer from 1 to 5.

Di(tallowoxyloxyethyl) dimethyl ammonium chloride and/or its hardened tallow analogue is especially preferred of the compounds of formula (II).

A second preferred type of quaternary ammonium material can be represented by the formula (III):

(III)

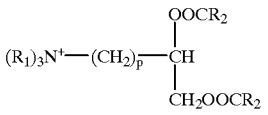

wherein $R_1$, p and $R_2$ are as defined above.

It is advantageous if the quaternary ammonium material is biologically biodegradable.

Preferred materials of this class such as 1,2-bis(hardened tallowoyloxy)-3-trimethylammonium propane chloride and their methods of preparation are, for example, described in U.S. Pat. No. 4,137,180, (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride.

Other useful cationic softening agents are alkyl pyridinium salts and substituted imidazoline species. Also useful are primary, secondary and tertiary amines and the condensation products of fatty acids with alkylpolyamines.

The compositions may alternatively or additionally contain water-soluble cationic fabric softeners, as described in GB 2 039 556B (Unilever).

The compositions may comprise a cationic fabric softening compound and an oil, for example as disclosed in EP-A-0829531.

The compositions may alternatively or additionally contain nonionic fabric softening agents such as lanolin and derivatives thereof.

Lecithins are also suitable softening compounds.

Nonionic softeners include Lβ phase forming sugar esters (as described in M Hato et al Langmuir 12, 1659, 1666, (1996)) and related materials such as glycerol monostearate or sorbitan esters. Often these materials are used in conjunction with cationic materials to assist deposition (see, for example, GB 2 202 244. Silicones are used in a similar way as a co-softener with a cationic softener in rinse treatments (see, for example, GB 1 549 180).

The compositions may also suitably contain a nonionic stabilising agent. Suitable nonionic stabilising agents are linear $C_8$ to $C_{22}$ alcohols alkoxylated with 10 to 20 moles of alkylene oxide, $C_{10}$ to $C_{20}$ alcohols, or mixtures thereof. Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

The composition can also contain fatty acids, for example $C_8$ to $C_{24}$ alkyl or alkenyl monocarboxylic acids or polymers thereof. Preferably saturated fatty acids are used, in particular, hardened tallow $C_{16}$ to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

The fabric conditioning compositions include silicones, such as predominantly linear polydialkylsiloxanes, e.g. polydimethylsiloxanes or aminosilicones containing amine-functionalised side chains; and may also include soil release polymers such as block copolymers of polyethylene oxide and terephthalate; amphoteric surfactants; smectite type inorganic clays; zwitterionic quaternary ammonium compounds; and nonionic surfactants.

The fabric conditioning compositions may also include an agent which produces a pearlescent appearance, e.g. an organic pearlising compound such as ethylene glycol distearate, or inorganic pearlising pigments such as microfine mica or titanium dioxide ($TiO_2$) coated mica.

The fabric conditioning compositions may be in the form of emulsions or emulsion precursors thereof.

Other optional ingredients include emulsifiers, electrolytes (for example, sodium chloride or calcium chloride) preferably in the range from 0.01 to 5% by weight, pH buffering agents, and perfumes (preferably from 0.1 to 5% by weight).

Further optional ingredients include non-aqueous solvents, perfume carriers, fluorescers, colourants, hydrotropes, antifoaming agents, antiredeposition agents, enzymes, optical brightening agents, opacifiers, anti-shrinking agents, anti-wrinkle agents, anti-spotting agents, dye transfer inhibitors, germicides, fungicides, anti-oxidants, UV absorbers (sunscreens), heavy metal sequestrants, chlorine scavengers, dye fixatives, anti-corrosion agents, drape imparting agents, antistatic agents and ironing aids. This list is not intended to be exhaustive.

The invention will now be described by way of example only and with reference to the following non-limiting examples.

EXAMPLES

Examples 1–3

Experimental Procedure

The amine epichlorohydrin resin used in the following tests is Apomul SAK, (ex. Brookstone Chemicals) which has an azetidinum functional group. It was prepared as an aqueous solution and utilised as a percentage of the weight of fabric treated (% on weight of fabric (owf)) to show its effect on fabric dimensional stability.

Two types of fabric, cotton interlock and cotton poplin, were used in the procedure below. Each fabric was tested in the weft and warp direction, figures relating to the % dimensional change (by multiplying the % change in the weft direction by the % change in the warp direction) have been tabulated.

All fabrics pieces were pre-washed prior to treating (40° C. cotton wash in a Miele Novotronic W820 Front Loading Washing Machine, Wirral water, 100 g Persil non biological washing powder, then tumble dried in a Miele Novotronic T430 Tumble Dryer). The fabrics pieces were then marked up using the M&S Shrinkage Rule and labelled. Four pieces of each fabric type plus clean cotton sheeting made up a 2.5 kg load, which was washed (40° C. cotton wash in a Miele Novotronic W820 Front Loading Washing Machine, Wirral water, 100 g Persil non biological washing powder added in the main wash. Apomul SAK was added in the final rinse), then tumble dried in a Miele Novotronic T430 Tumble Dryer, and finally lightly ironed on both sides (cotton setting). Ironing only took place after the first wash. The fabric pieces were then conditioned for 24 hours at 65% RH, 20° C. The washing and drying stages were repeated until five washes were completed.

For determining the percentage dimensional change in using Apomul SAK in combination with a silicone component, the same experimental procedure as outlined above was followed, the treatment product being altered by the addition of a silicone component CT45E from Wacker.

The % dimensional change results are given in the tables below. % dimensional change was calculated the mean warp % values by the mean weft % values ie, the mean value is calculated from the values obtained before and after each such test.

Cotton Interlock - % Dimensional Change

| Wash Number | Water Control | SAK (0.27% owf) | EXAMPLE 1 15:1 by wt SAK/CT45E (0.047% owf) | EXAMPLE 2 10:1 by wt SAK/CT45E (0.07% owf) | EXAMPLE 3 5:1 by wt SAK/CT45E (0.14% owf) |
|---|---|---|---|---|---|
| 1 | 1.97 | 1.21 | 0.43 | 2.64 | 1.40 |
| 2 | 12.10 | 3.40 | 0.68 | 1.38 | 0.086 |
| 3 | 13.83 | 5.65 | 0.75 | 2.51 | 1.29 |
| 4 | 29.28 | 7.15 | 0.42 | 1.66 | 0.45 |
| 5 | 24.36 | 12.27 | 2.02 | 3.70 | 1.47 |

The results demonstrate the improvement in dimensional stability achieved by the use of Apomul SAK in combination with the silicone.

Cotton Poplin - % Dimensional Change

| Wash Number | Water Control | SAK (0.27% owf) | 15:1 by wt SAK/CT45E (0.047% owf) | 10:1 by wt SAK/CT45E (0.07% owf) | 5:1 by wt SAK/CT45E (0.14% owf) |
|---|---|---|---|---|---|
| 1 | 0.22 | 0.18 | 0.32 | 0.24 | 0.04 |
| 2 | 1.11 | 0.31 | 0.17 | 0.47 | 0.14 |
| 3 | 1.37 | 0.33 | 0.41 | 0.75 | 0.50 |
| 4 | 2.10 | 0.37 | 1.16 | 0.56 | 0.41 |
| 5 | 3.60 | 1.11 | 0.65 | 1.01 | 0.72 |

The results again demonstrate the improvement in dimensional stability achieved by the use of Apomul SAK™ in combination with the silicone.

Example 4

Each load consisted of ten 45 cm×45 cm pieces of cotton sheeting, six 45 cm×45 cm pieces of 50:50 polycotton, five 45 cm×45 cm interlock and the load made up to 1 kg using cotton sheeting ballast. The experiments were done in duplicate with each load being combined for tumble drying. Each load was washed in a Miele® machine using a 40° C. economy wash and either no additive to the rinse (untreated), CT 45E silicone polymer from Wacker (0.5% owf) or a composition according to the invention containing a PAE (0.32% owf) (Apomul SAK™) and CT45E (0.18% owf). After tumble drying in a Miele® machine on normal setting until the anti-crease finish had been obtained, the cotton sheeting samples were panelled against standards (the best two and worst two samples were removed prior to panelling).

The results of the panel testing on a scale of 0 for no creasing to 100 for maximum creasing are as follows:

| Treatment | Average Score |
|---|---|
| Untreated | 68.73 |
| CT45E | 77.06 |
| PAE/CT45E | 57.62 |

Example 5

The previous example was repeated using loads consisting of ten 40 cm×40 cm pieces of cotton sheeting, six 40 cm×40 cm pieces of 50:50 polycotton, five 40 cm×40 cm pieces of interlock and the load made up to 1 kg using cotton sheeting ballast. The additives added to the rinse were none (untreated), Comfort® fabric conditioner (0.25% owf) or the composition according to the invention as used in the previous example. The loads were varied in each machine ensuring that after 5 loads each treatment had been in the same number of machines. After each wash the loads were combined and dried in a Miele® tumble dryer on normal setting until the anti-crease finish had been obtained. The cotton sheeting samples were panel tested after the fifth wash.

The results are as follows:

| Treatment | Average Score |
|---|---|
| Untreated | 74.21 |
| Comfort ® | 50.24 |
| PAE/CT45E | 37.54 |

Example 6

Three sets of eight different garments purchased from a Marks & Spencer store were washed five times in a Miele® washing machine on cotton programme at 40° C.

The garments were:

i. Mid green men's heavy cotton drill shirt, 100% cotton ii. Children's Rugrats™ pyjamas, 100% cotton iii. Mid blue men's shirt, 65:35 polycotton iv. Light blue men's shirt, 65:35 polycotton V. Dark blue 'easy care' men's shirt, 45:55 polycotton vi. Camouflage boys teeshirt, 100% cotton vii. Navy blue jeans, 98% cotton 2% elastane viii. Navy, royal and white striped men's rugby shirt, 100% cotton All three sets of garments were washed with 65 g Persil® detergent with rinse treatments containing no additive (untreated), 21 g Comfort ® fabric conditioner (Comfort) or a composition according to the invention (invention) containing 27.1 g PAE (Apomul SAK™) and 5.9 g CT45E.

After washing, the garments were panelled by 20 people. Each person was asked to compare the untreated, comfort and invention garments from each set and to carry out the following assessments:

1. Rank the garments in terms of creasing.
2. State which garments need ironing.
3. State which garment has the best overall appearance.
4. State which garment has the best feel.
5. State which garment has the best feel and appearance.

The crease ranking was carried out by giving each garment a score of 1, 2 or 3, with 1 being least creased and 3 the most creased.

For the ironing assessment, a score of 1 was given to indicate that ironing is required and a score of 0 indicated that no ironing is required.

The results are given below:

| Garment | Treatment | Crease Ranking | Ironing Requirement | Overall Appearance | Feel | Feel/Overall Appearance |
|---|---|---|---|---|---|---|
| Mid-blue shirt | Untreated | 2.65 | 0.85 | 0.10 | 0 | 0.05 |
| | Comfort | 1.95 | 0.7 | 0.15 | 0.10 | 0.10 |
| | Invention | 1.45 | 0.35 | 0.75 | 0.85 | 0.80 |
| Light blue shirt | Untreated | 2.60 | 1.00 | 0.10 | 0 | 0.05 |
| | Comfort | 1.45 | 0.70 | 0.65 | 0.45 | 0.65 |
| | Invention | 1.90 | 0.80 | 0.25 | 0.75 | 0.30 |
| Rugby Shirt | Untreated | 2.70 | 0.75 | 0.05 | 0 | 0 |
| | Comfort | 2.40 | 0.55 | 0.10 | 0 | 0.05 |
| | Invention | 1.10 | 0.15 | 0.85 | 0.95 | 0.95 |
| Jeans | Untreated | 3.00 | 1.00 | 0 | 0 | 0 |
| | Comfort | 1.90 | 0.25 | 0.15 | 0.25 | 0.10 |
| | Invention | 1.05 | 0.10 | 0.85 | 0.80 | 0.90 |

-continued

| Garment | Treatment | Crease Ranking | Ironing Requirement | Overall Appearance | Feel | Feel/Overall Appearance |
|---|---|---|---|---|---|---|
| Dark blue shirt | Untreated | 2.95 | 1.00 | 0.05 | 0 | 0 |
| | Comfort | 1.40 | 0.20 | 0.55 | 0.25 | 0.35 |
| | Invention | 1.55 | 0.20 | 0.40 | 0.75 | 0.60 |
| Childs pyjamas | Untreated | 2.95 | 0.85 | 0.15 | 0 | 0 |
| | Comfort | 1.90 | 0.20 | 0.05 | 0.30 | 0.25 |
| | Invention | 1.10 | 0.05 | 0.75 | 0.75 | 0.85 |
| Dark green shirt | Untreated | 3.00 | 1.00 | 0 | 0.05 | 0 |
| | Comfort | 1.75 | 0.85 | 0 | 0.25 | 0.10 |
| | Invention | 1.15 | 0.55 | 0.90 | 0.80 | 0.85 |
| Camouflage T-Shirt | Untreated | 2.70 | 0.90 | 0 | 0 | 0 |
| | Comfort | 2.25 | 0.75 | 0.10 | 0.10 | 0.10 |
| | Invention | 1.05 | 0.10 | 0.90 | 0.95 | 0.90 |

Examples 7 A–E

Tests were carried out on the crease recovery angle (CRA) of a fabric (100% cotton sheeting; undyed, unfinished, non-mercerised) with compositions 7A–E according to the invention padded onto 50 mm×25 mm pieces of the fabric (6 pieces in the warp direction and 6 pieces in the weft direction) at levels of about 6.5% owf and at a pH of about 7.5. The ratio of silicone to PAE was varied to demonstrate the synergistic effect of using PAE and silicone together. CRA was measured by conditioning the pieces for 24 hours at 20° C., 65% RH. The samples were folded in half and placed under a 1 kg load for 60 seconds. The fabric piece was then placed into a CRA protractor and the fold angle measured after 60 seconds recovery. The average warp and weft values were combined to give an overall CRA value.

| Treatment | PAE[a] (%) | Silicone[b] (%) | Resin owf (%) | Average CRA[c] (°) |
|---|---|---|---|---|
| None (control) | 0 | 0 | 0 | 135.33 |
| Silicone | 0 | 100 | 6.6 | 214.90 |
| 7A | 10 | 90 | 6.6 | 232.53 |
| 7B | 25 | 75 | 6.6 | 232.17 |
| 7C | 50 | 50 | 6.4 | 228.33 |
| 7D | 75 | 25 | 6.1 | 228.33 |
| 7E | 90 | 10 | 6.2 | 204.00 |
| PAE | 100 | 0 | 5.48 | 173.33 |

All percentages are by weight
[a]Apomul SAK
[b]CT45E aminosilicone (Wacker)
[c]Warp + weft average values

Example 8 A–G

The following are examples of compositions according to the invention which have been formulated for use as adjuncts in the rinse cycle of a domestic laundering process.

| Example | PAE[a] (%) | Silicone[b] (%) | Perfume[c] (%) | Ratio PAE:Silicone |
|---|---|---|---|---|
| 8A | 69.9 | 29.6 | 0.5 | 1:2 |
| 8B | 82.1 | 17.4 | 0.5 | 1:1 |
| 8C | 88.9 | 10.6 | 0.5 | 1.78:1 |
| 8D | 90.0 | 9.5 | 0.5 | 2:1 |
| 8E | 88.9 | 10.6 | 0.5 | 1.78:1 |
| 8F | 88.9 | 10.6 | 0.5 | 1.78:1 |
| 8G | 88.9 | 10.6 | 0.5 | 1.78:1 |

-continued

| Example | PAE[a] (%) | Silicone[b] (%) | Perfume[c] (%) | Ratio PAE:Silicone |
|---|---|---|---|---|

All percentages are by weight
[a]Kenores 1440 (13.5% active)
[b]CT45E (Wacker) aminosilicone
[c]Examples A–D - Dandi Lion (IFF)
Example E - Lilial
Example F - Limonene
Example 9 - Citronellol

What is claimed is:

1. Fabric care composition comprising an amine or amide-epichlorohydrin resin or derivative thereof, a silicone component in the ratio of resin to silicone as 5:1 to 15:1 and, optionally, a textile compatible carrier, wherein the textile compatible carrier facilitates contact between the resin and a fabric, the composition being adapted for use in the rinse cycle of a laundering process.

2. Fabric care composition as claimed in claim 1 wherein the textile compatible carrier is a fabric softening and/or conditioning compound.

3. Fabric care composition as claimed in claim 1, wherein the amine or amide-epichlorohydrin resin has one or more functional groups capable of forming azetidinium groups.

4. Fabric care composition as claimed in claim 3, wherein the amine or amide-epichlorohydrin resin has one or more azetidinium functional groups.

5. Fabric care composition as claimed in claim 1, wherein the amine or amide-epichlorohydrin resin or derivative thereof has 1 or more functional groups that contain epoxide groups or derivatives thereof.

6. Fabric care composition according to claim 1 wherein an amine or amide-epichlorohydrin resin or derivative thereof is present in the composition in an amount such that from 0.0005% to 5% by weight on weight of fabric is provided.

7. Fabric care composition according to claim 1 wherein the silicone comprises at least one aminoalkyl group.

8. A method of treating fabric comprising the step of applying to fabric a fabric care composition as defined in claim 1 as part of a laundering process.

9. Method as claimed in claim 8, wherein the fabric comprises a cellulosic fibre.

10. Method as claimed in claim 9, wherein the cellulosic fibre is cotton or regenerated cellulose.

* * * * *